US011550250B2

(12) United States Patent
Takagi

(10) Patent No.: US 11,550,250 B2
(45) **Date of Patent: *Jan. 10, 2023**

(54) HEATER AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Osamu Takagi, Chofu Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 104 days.

This patent is subject to a terminal disclaimer.

(21) Appl. No.: 17/130,218

(22) Filed: Dec. 22, 2020

(65) Prior Publication Data

US 2021/0109469 A1 Apr. 15, 2021

Related U.S. Application Data

(63) Continuation of application No. 16/862,282, filed on Apr. 29, 2020, now Pat. No. 10,901,355, which is a continuation of application No. 16/224,410, filed on Dec. 18, 2018, now Pat. No. 10,678,173, which is a continuation of application No. 15/250,624, filed on Aug. 29, 2016, now Pat. No. 10,191,422.

(51) Int. Cl.
*G03G 15/20* (2006.01)

(52) U.S. Cl.
CPC ..... *G03G 15/2057* (2013.01); *G03G 15/2053* (2013.01)

(58) Field of Classification Search
CPC ..... G03G 15/2053; G03G 15/2057; G03G 15/2017; G03G 15/2046; G03G 15/205
See application file for complete search history.

(56) References Cited

U.S. PATENT DOCUMENTS

| | | | |
|---|---|---|---|
| 4,296,801 | A | 10/1981 | Guex et al. |
| 6,794,611 | B2 | 9/2004 | Kataoka et al. |
| 6,963,131 | B2 | 11/2005 | Frisch et al. |
| 7,747,195 | B2 | 6/2010 | Yoshino et al. |
| 10,108,117 | B2 | 10/2018 | Shibuya |
| 10,191,422 | B2 | 1/2019 | Takagi |
| 10,678,173 | B2 | 6/2020 | Takagi |
| 2008/0138131 | A1 | 6/2008 | Jung et al. |
| 2012/0243923 | A1 | 9/2012 | Uehara et al. |
| 2019/0146389 | A1 | 5/2019 | Takagi |

*Primary Examiner* — Erika J. Villaluna
(74) *Attorney, Agent, or Firm* — Kim & Stewart LLP

(57) ABSTRACT

Embodiments disclosed herein generally relate to a heater, comprising an insulator substrate, a first member, a plurality of electrodes, and a second member. The first member is configured to generate heat on an upper surface of the insulator substrate across a first direction. The first member has a first end opposite a second end. The plurality of electrodes are formed on both the first end and the second end of the first member, respectively, and each electrode is disposed in a direction perpendicular to the first direction. The second member is configured to store heat. The second member comprises a latent heat material having latent heat in a target temperature zone. Furthermore, the latent heat material is fixed to a side surface or a bottom surface of the insulator substrate.

20 Claims, 6 Drawing Sheets

HEATER AND IMAGE FORMING APPARATUS

CROSS-REFERENCE TO RELATED APPLICATIONS

This application is a continuation of U.S. patent application Ser. No. 16/862,282, filed on Apr. 29, 2020, which is a continuation of U.S. patent application Ser. No. 16/224,410, filed on Dec. 18, 2018, now U.S. Pat. No. 10,678,173, granted on Jun. 9, 2020, which is a continuation of U.S. patent application Ser. No. 15/250,624, filed on Aug. 29, 2016, now U.S. Pat. No. 10,191,422, granted on Jan. 29, 2019, the entire contents of each of which are incorporated herein by reference.

FIELD

Embodiments described herein generally relate to a heater and an image forming apparatus.

BACKGROUND

Typically, in a fixing device, a heat source is mounted on an image forming apparatus and a lamp emits infrared rays to transpose type onto a medium. In some embodiments, a halogen lamp may be utilized to perform the transposition via electromagnetic induction.

In general, fixing devices include a heating roller (or a fixing belt with a plurality of rollers disposed thereon) and a press roller. However, it is necessary to reduce the heat capacity of each component as much as possible and to further concentrate heating areas of the fixing device in order to maximize overall thermal efficiency. Furthermore, typical heating widths are wide, thus making it difficult to intensively provide widely distributed thermal energy to a nip portion as a way to optimize thermal efficiency.

Furthermore, fixing quality within the fixing device for an electronic photograph is affected if heat generated unevenness is present in a paper transport direction (a first direction) and in a perpendicular direction. Particularly, with respect to color printing, heat generated unevenness produces differences in color developing and/or generates a gloss-like appearance.

Additionally, in a fixing device in which heat capacity has been significantly reduced, additional problems with respect to speed irregularity, warp or deterioration of the belt, and/or expansion of the transport roller exist in that the temperature section of the fixing device through which paper does not pass (non-paper passing area) is increased dramatically. Due to energy conservation concerns, heating of the section of the non-paper passing area is not preferable. As such, due to environmental concerns, an apparatus or method that provides energy to the nip portion which heats only the passing area of the paper or the image forming area in the paper has become an area of focus in the field.

In some cases, a silicone rubber layer is provided to the belt of the fixing device. A difference in temperature between the heater and the belt is generated via thermal insulation with the silicone rubber layer, and therefore temperature control helps to maintain the nip area at a predetermined fixing process temperature. However, it is difficult to control the non-paper passing area as the temperature therein rapidly changes. Furthermore, high image quality is maintained via precise temperature control when heat generation is performed by dividing a resistance heating body. As such, it is often useful to control the temperature separately in each division unit; however, overall device size may be increased due to the measurement and control devices.

DETAILED DESCRIPTION

Embodiments disclosed herein generally relate to a heater, comprising an insulator substrate, a first member, a plurality of electrodes, and a second member. The first member is configured to generate heat on an upper surface of the insulator substrate across a first direction. The first member has a first end opposite a second end. The plurality of electrodes are formed on both the first end and the second end of the first member, respectively, and each electrode is disposed in a direction perpendicular to the first direction. The second member is configured to store heat. The second member comprises a latent heat material having latent heat in a target temperature zone. Furthermore, the latent heat material is fixed to a side surface or a bottom surface of the insulator substrate.

Figure 1:
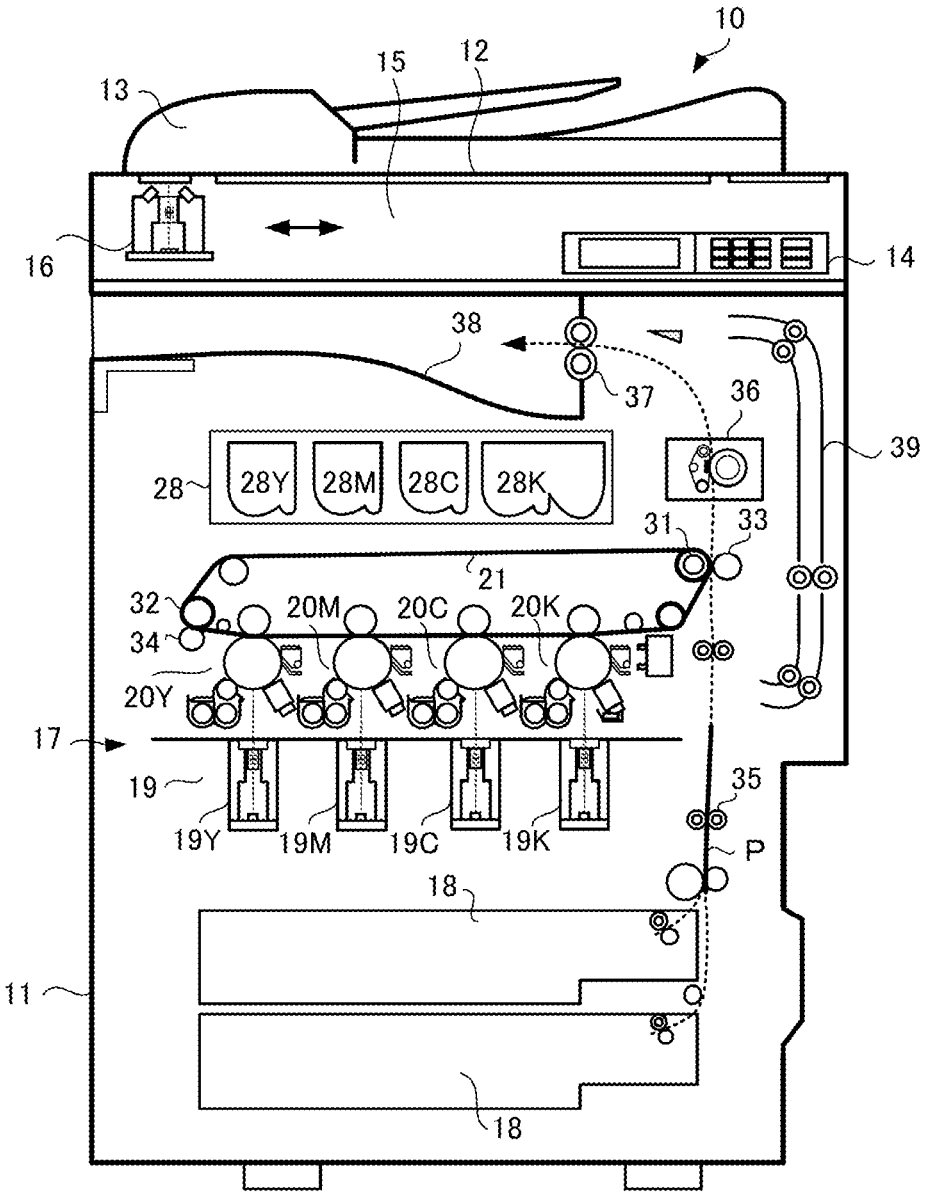
FIG. 1 is a schematic side view of an image forming apparatus having a fixing device, according to one embodiment described herein.

FIG. 1 is a schematic side view of an image forming apparatus 10 using a fixing device, according to one embodiment. In some embodiments, the image forming apparatus 10 is, for example, a multi-function peripheral (MFP) which is a multifunction machine, a printer, a copying machine, or the like. Hereinafter, by way of example only, the MFP will be described.

The MFP includes a document table 12 disposed on the upper portion of a main body 11 of the MFP 10 and an automatic document feeder (ADF) 13 disposed on the document table 12. In certain embodiments, the document table 12 may comprise a transparent glass material. The ADF 13 may be configured to operate in an openable and closable manner. In addition, an operating panel 14 is disposed on the upper portion of the main body 11. The operating panel 14 includes various keys and a display unit, for example, a touch panel.

A scanner unit 15 configured as a reading device is disposed in the lower portion of the ADF 13 and within the main body 11. The scanner unit 15 may generate image data by reading a document sent by the ADF 13 or a document disposed on the document table. Furthermore, the scanner unit 15 includes a contact-type image sensor 16 (hereinafter, simply referred to as an image sensor). The image sensor 16 is oriented in the main scanning direction (See, FIG. 1, in a depth direction).

Once an image of a document is placed on the document table 12, the image sensor 16 reads the document image line by line while moving along the document table 12. Each page of the document is read by the image sensor regardless of document size. Furthermore, the image sensor 16 is in a fixed position, as illustrated in FIG. 1, for reading the image of the document sent by the ADF 13.

In addition, the printer unit 17 is provided in a center portion of the main body 11, and a plurality of paper feed cassettes 18 in which various sizes of paper P are accepted are provided in a lower portion of the main body 11. The printer unit 17 includes a photosensitive drum and a scanner head 19. The scanner head 19 includes an LED therein as a light exposing device. The image is generated by scanning the photosensitive drum with light from the scanner head 19.

The printer unit 17 generates the image on paper. The printer unit 17 is configured to process image data read by the scanner unit 15 as well as image data generated by a personal computer, or other similar device. In some embodiments, the printer unit 17 is a color laser printer, for example a tandem system. The printer unit includes image forming units 20Y, 20M, 20C, and 20K having yellow (Y), magenta (M), cyan (C), and black (K) colors, respectively. The image forming units 20Y, 20M, 20C, and 20K are placed in a lower side of an intermediate transfer belt 21 in parallel along a downstream side from an upstream side. In addition, the scanner head 19 also includes a plurality of scanner heads 19Y, 19M, 19C, and 19K corresponding to the image forming units 20Y, 20M, 20C, and 20K.

Figure 2:
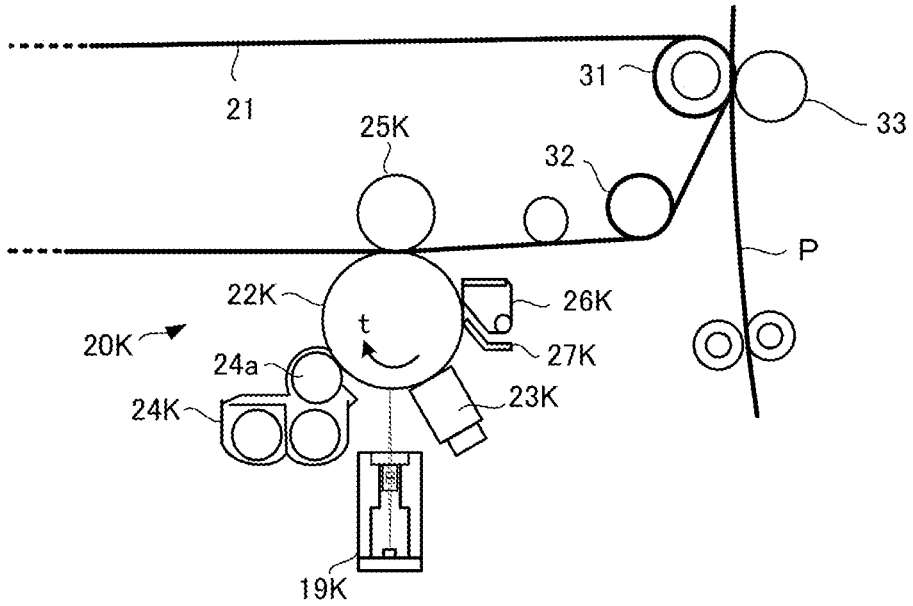
FIG. 2 is an enlarged schematic view of a portion of the image forming unit of FIG. 1.

FIG. 2 is an enlarged schematic view of a portion of the image forming unit of FIG. 1. FIG. 2 illustrates the image forming unit 20K of the image forming units 20Y, 20M, 20C, and 20K. Furthermore, since each of the image forming units 20Y, 20M, 20C, and 20K has the same, or similar, construction as will be described below, only the image forming unit 20K is described herein, as an example.

The image forming unit 20K includes a photosensitive drum 22K. In some embodiments, the photosensitive drum 22K may be an image carrier. A charger 23K, a developing unit 24K, a primary transfer roller (transfer unit) 25K, a cleaner 26K, and a blade 27K, or the like, is arranged around the photosensitive drum 22K along the rotational direction t. An electrostatic latent image is formed on the photosensitive drum 22K in the light exposing position of the photosensitive drum 22K by being irradiated with light from the scanner head 19K.

The charger 23K of the image forming unit 20K may uniformly charge the surface of the photosensitive drum 22K. The developing unit 24K supplies two-component developer to the photosensitive drum 22K. The two-component developer may contain a black toner and the carrier. As such, the two-component developer is supplied via the developing roller 24*a* to which a developing bias is applied and, thus, the electrostatic latent image is developed. The cleaner 26K removes residual toner on the surface of the photosensitive drum 22K using the blade 27K.

In addition, as illustrated in FIG. 1, a toner cartridge 28 that supplies toner to the developing units 24Y to 24K is provided on the upper portion of the image forming units 20Y to 20K. The toner cartridge 28 includes toner cartridges 28Y, 28M, 28C, and 28K having yellow (Y), magenta (M), cyan (C), black (K) colors, respectively.

The intermediate transfer belt 21 moves cyclically. The intermediate transfer belt 21 is stretched across the driving roller 31 and the driven roller 32. In addition, the intermediate transfer belt 21 is in contact so as to face the photosensitive drums 22Y to 22K. In a position facing the photosensitive drum 22K of the intermediate transfer belt 21, a primary transfer voltage is applied by a primary transfer roller 25K and thus a toner image on the photosensitive drum 22K is primarily transferred to the intermediate transfer belt 21.

A secondary transfer roller 33 is disposed to face the driving roller 31 which stretches the intermediate transfer belt 21. When the paper P passes between the driving roller 31 and the secondary transfer roller 33, a secondary transfer voltage is applied to the paper P by the secondary transfer roller 33. Then, the toner image on the intermediate transfer belt 21 is secondarily transferred to the paper P. A belt cleaner 34 is disposed in the vicinity of the driven roller 32 of the intermediate transfer belt 21. In some embodiments, the belt cleaner 34 is disposed adjacent the driven roller 32 of the intermediate transfer belt 21.

In addition, as illustrated in FIG. 1, a paper feed roller 35, by which the paper P is removed from the inside of a paper feed cassette 18, is provided between the paper feed cassette 18 and the secondary transfer roller 33.

Furthermore, a fixing device 36 is provided downstream of the secondary transfer roller 33. In addition, a transport roller 37 is provided downstream of the fixing device 36. The transport roller 37 discharges the paper P to a paper discharging portion 38. Furthermore, a reverse transport path 39 is provided downstream of the fixing device 36. The reverse transport path 39 reverses and/or guides the paper P in the direction of the secondary transfer roller 33, and may be used when performing a duplex printing. FIGS. 1 and 2 are views illustrating the exemplary embodiment, however, a structure of the image forming device portion, in addition to the fixing device 36, is not limited to that shown.

Figure 3:
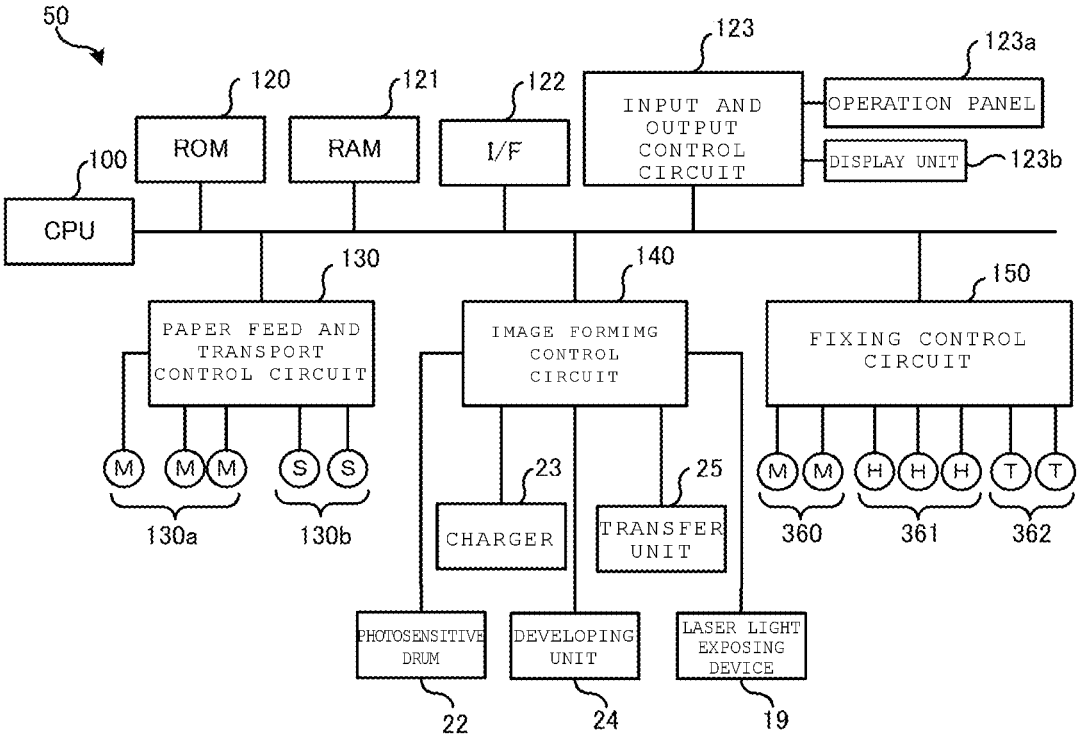
FIG. 3 is a schematic block diagram of a control system of an MFP, according to one embodiment described herein.

FIG. 3 is a schematic block diagram of a control system of an MFP 10. The control system 50 includes, for example, a CPU 100 controlling the whole MFP 10, a read only memory (ROM) 120, a random access memory (RAM) 121, an interface (I/F) 122, an input and output control circuit 123, a paper feed and transport control circuit 130, an image forming control circuit 140, and a fixing control circuit 150.

The CPU 100 is configured to achieve a processing function for image forming by executing a program that is stored in the ROM 120 or the RAM 121. A control program and control data that control a basic operation of the image forming processing are each stored in the ROM 120. The RAM 121 is a working memory. For example, a control program for the image forming unit 20, the fixing device 36, or the like and various types of control data used by the control program are stored in the ROM 120 (or the RAM 121). As a specific example of the control data according to the present embodiment, there is a corresponding relationship between a size of a print area on the paper (a width in a main scanning direction) and a heat generating member which is a power supplying target, or the like.

A fixing temperature control program of the fixing device 36 includes determination logic configured to determine a size of the image forming area on the paper on which the toner image is formed. Furthermore, the temperature control program of the fixing device 36 also includes heating control logic configured to control heating by a heating unit. In some embodiments, heating may be controlled by selecting a switching element of a heat generating member which corresponds to a position through which the image forming area is passed before the paper is transported to the inside of the fixing device 36 and before power is supplied.

The I/F 122 communicates with various devices, such as a user terminal or a facsimile. The input and output control circuit 123 is configured to control an operation panel 123*a* and/or a display unit 123*b*. The paper feed and transport control circuit 130 is configured to control a motor group 130*a*, or the like, wherein the motor group 130 drives the paper feed roller 35, the transport roller 37 of the transport path, or the like. The paper feed and transport control circuit 130 is configured to control the motor group 130*a*, or the like, by receiving and/or analyzing the detecting result of various sensors 130*b*. The various sensors 130*b* may be disposed on or near the transport path or the paper feed cassette 18. In some embodiments, the result of the various sensors 130*b* may be determined based on the control signal received from the CPU 100. The image forming control circuit 140 is configured to control the photosensitive drum 22, the charger 23, the laser light exposing device 19, a developing unit 24, or a transfer unit 25 based on the control signal received from the CPU 100. The fixing control circuit 150 is configured to control the driving motor 360 of the fixing device 36, the heating member 361 (heater), a temperature detecting member 362—such as a thermistor—based on the control signal received from the CPU 100. Further, in certain embodiments the control program and the control data of the fixing device 36 may be stored in a storage device of the MFP 10, and subsequently executed by the CPU 100. However, in some embodiments, an arithmetic processing device and a storage device may be separately provided for the fixing device 36 only.

Figure 4:
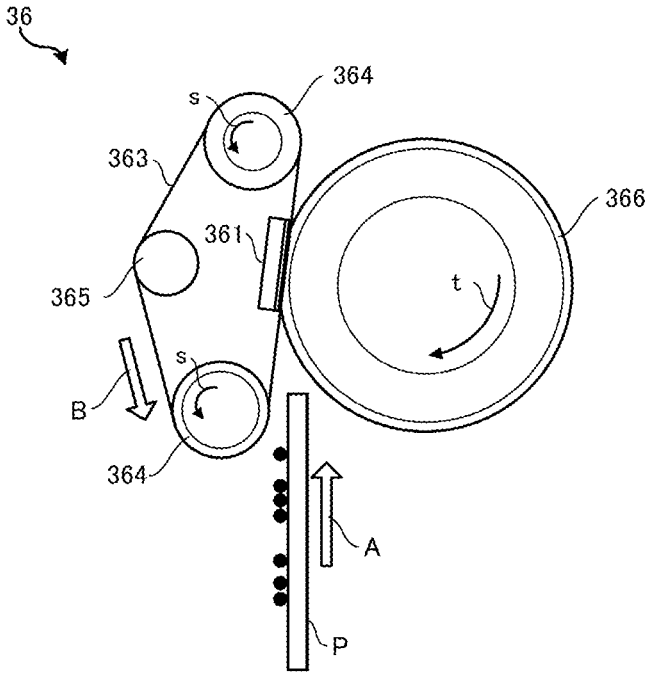
FIG. 4 schematically illustrates a side view of the fixing device of FIG. 1.

FIG. 4 illustrates a side view of the fixing device 36 of FIG. 1. As shown, the fixing device 36 includes a plate shaped heating member 361, a belt 363 that has an elastic layer and which is stretched by a plurality of rollers in a loop, a belt transport roller 364 that drives the belt 363, a tension roller 365 that applies tension to the belt 363, and a press roller 366 that has a surface on which an elastic layer is formed. The heat generating member side of the heating member 361 contacts the inside of the belt 363, and the heating member 361 is pressed toward the press roller 366. As such, the heating member 361 forms a fixing nip having a predetermined width between the press roller 366 and the heating member 361. Heating is performed by the heating member 361 at a nip area.

The belt 363 may comprise a SUS based material. In some embodiments, the SUS based material may have a thickness of about 50 μm. In other embodiments, the belt 363 may include a polyimide material which includes a heat resistant resin. In certain embodiments, the heat resistant resin may have a thickness of about 70 μm. A silicone rubber layer with a thickness of 200 μm may be formed on the outer side of the belt 363. The outermost periphery the belt 363 may be coated with a surface protective layer, such as a PFA. The press roller 366, for example, may have a silicone sponge layer with a thickness of about 5 mm on a steel rod surface of about 010 mm, and the outermost periphery thereof may be coated with a surface protective layer, such as PFA.

In addition, a heat generating resistive layer, a glaze layer and/or a heat generating resistive layer may be stacked on an insulating body, such as a ceramic substrate, in the heating member 361. The heat generating resistive layer may comprise, by way of example only, a material containing $TaSiO_2$. The heat generating layer may be divided into a predetermined length and/or number or segments in the main scanning direction. Hereinafter, the division of the heat generating resistive layer will be described in detail.

A method of forming the heat generating resistive layer may be similar to methods of making a thermal head. The method includes forming an aluminum masking layer on the heat generating resistive layer. Insulation is disposed between adjacent heat generating members, and, in some embodiments, an aluminum layer is formed in a pattern in which the heat generating member is exposed in a paper transport direction. In some embodiments, the heat generating member may be a resistive heating body. The supplying of power to the heat generating member is achieved by being connected from an aluminum layer (for example, an electrode) of both end portions thereof to a conductor via wiring. Furthermore, both end portions of the conductor may be connected to switching elements of the switching driver IC. Furthermore, in order to cover all the resistive heat generating body, the aluminum layer, the wiring, and a protective layer may be formed on the top portion thereof. The protective layer is may comprise, for example, $Si_3N_4$ or the like. If AC or DC is supplied to the heat generating member group, portions in which heat is generated by a triac or a FET may be supplied power at zero-cross to prevent and/or account for flicker.

Figure 5:
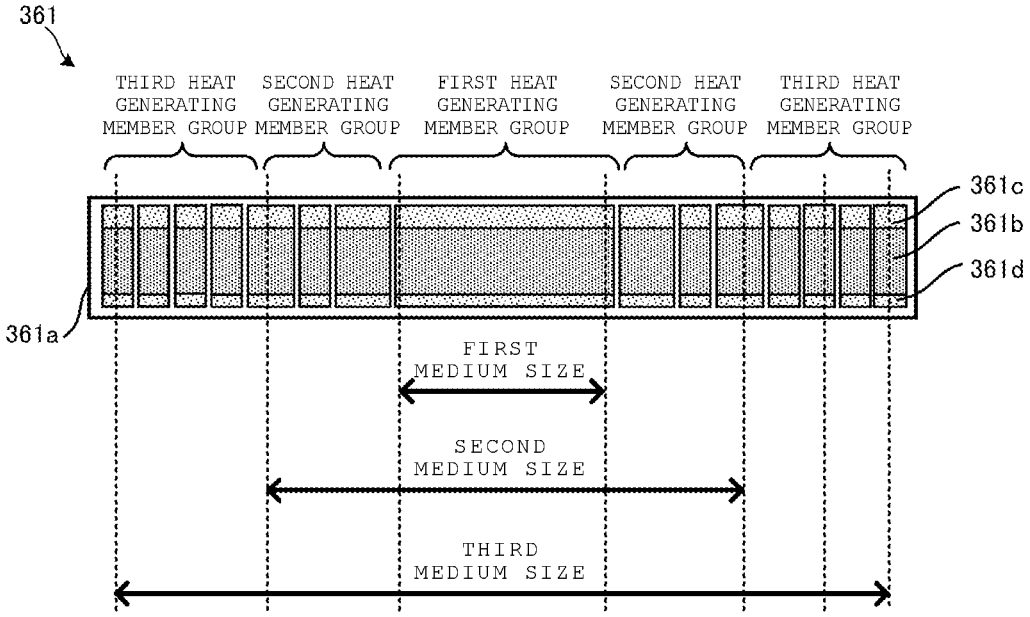
FIG. 5 schematically illustrates a layout view of a heat generating member group in a heating member of FIG. 4, according to one embodiment described herein.

FIG. 5 schematically illustrates a layout view of a heat generating member group in a heating member 361 as illustrated in FIG. 4. The heating member 361 is divided into the three types of lengths of the heat generating members (heat generating elements) so as to approximately correspond to a postcard size (100 mm×148 mm), a CD jacket size (121 mm×121 mm), a B5R size (182 mm×257 mm), or an A4R size (210 mm×297 mm) and thus is classified into three heat generating member groups. By considering the transport accuracy or skew of the transported paper, or the escape of heat of the non-heating portion, the heat generating member group is energized to have a margin of about 5% in the heating region.

In the embodiment of FIG. 5, so as to correspond to the width of the postcard size (which is the minimum size) as described above, the first heating member group is provided in a central portion and in the main scanning direction (the lateral direction in FIG. 5). Furthermore, the width of the first heating member group is approximately 105 mm. To correspond to the next larger sizes (121 mm and 148 mm, respectively), the second heat generating member groups of the width 25 mm×2 are provided on the outside of the first heat generating member group (shown as the lateral direction in FIG. 5), to cover the width of up to about 155 mm, that is, approximately 148 mm+about 5%. To correspond to the larger size (182 mm and 210 mm, respectively), the third heat generating member groups of the width 32.5 mm×2 are provided on the outside of the second heat generating member group, to cover the width of up to about 220 mm, that is, about 210 mm+about 5%.

Further, a division number and a width of each of the heat generating member groups are described by way of example, but the division number and the width of each of the heat generating member groups are not limited to the example. For example, if the MFP 10 corresponds to five medium sizes, the heat generating member group may be divided into five heat generating member groups in accordance with each medium size.

Further, in the present embodiment, a line sensor (not illustrated) may be placed in the paper passing area. In this way, it is possible to determine the size and position of the paper to be passed therethrough in real time. The line sensor may be configured to determine the paper size from the image data and/or the information of the paper feed cassette 18 in which the paper is stored in the MFP 10 at the time of the start of a printing operation.

Figure 6:
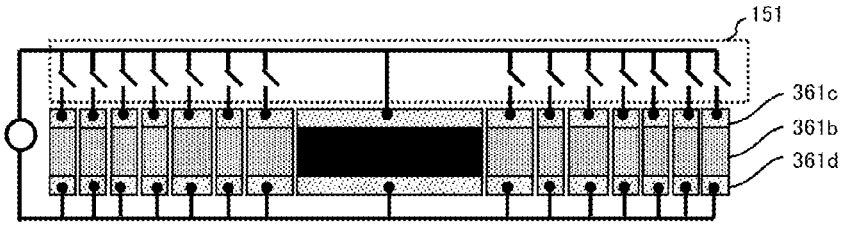
FIG. 6 is a schematic view of the heat generating member group and a drive circuit thereof in the heating member of FIG. 4.

FIG. 6 is a schematic view of the heat generating member group and a drive circuit thereof in the heating member of FIG. 4. As illustrated in FIG. 6, electrodes 361*c* and 361*d* are formed on both end portions of the heat generating member 361*b* and in the paper transport direction (the vertical direction, as shown in FIG. 6). Energizing each heat generating member 361*b* is individually controlled by the corresponding drive ICs 151*a* to 151*d*. The drive ICs 151*a* to 151*d* may be a switching unit of the target, a switching element, an FET, a triac, a switching IC, or the like.

Figure 7:
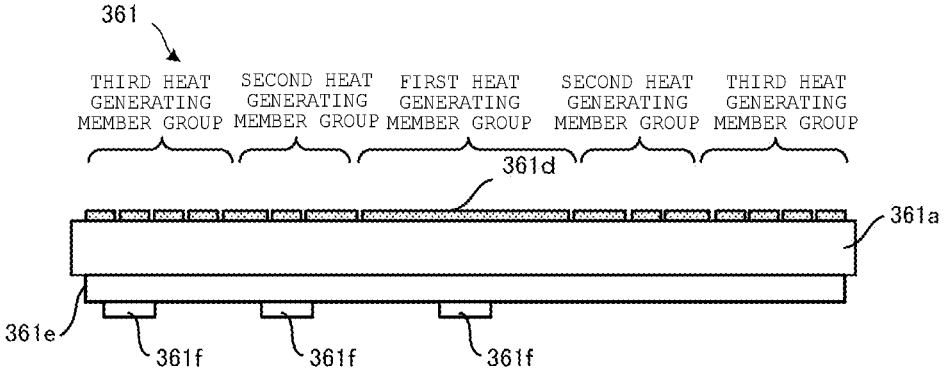
FIG. 7 is a schematic side view of the heating member of FIG. 4.

FIG. 7 is a schematic side view of the heating member of FIG. 4. Herein, the heat storage member 361*e* is fixed to the bottom surface of the insulator substrate 361*a*. A latent heat material having a latent heat in a target temperature zone of the fixing process is included in the heat storage member 361*e*. In addition, the heat storage member 361*e* may be disposed on the side surface of the insulator substrate 361*a*. The latent heat material of the heat storage member 361*e* includes a sugar and alcohol-based material (for example, a mannitol, a xylitol, or the like) as a component. Since the mannitol has a melting point of about 166° C. to 168° C., which is close to the fixing processing temperature, mannitol is suitable for storing the heat of the fixing device 36 in a high temperature state.

Additionally, a plurality of the temperature detecting elements 361*f* are provided on the bottom surface of the heat storage member 361*e*, so as to respectively detect the temperature in the predetermined position of the heat storage member 361*e*. Herein, as the heat generating member 361*b* is classified into three heat generating member groups, the temperature detecting element 361*f* is arranged in three positions, such that at least one detecting element 361*f* corresponds to each group.

In this way, according to the fixing device 36 of the present embodiment, the following effects and/or benefits are achieved.

(1) The temperature of the heating member 361 and the belt may be prevented from exceeding the predetermined upper limit temperature. For example, it is possible to make small increases in temperature even in the non-paper passing area where the temperature has rapidly increased in the heater structure in the related art.

(2) After termination of the printing processing, excess heat of the heat generating member 361*b* may be stored in the heat storage member 361*e*. For example, once the heat storage member 361*e* reaches a predetermined temperature and the heat storage member is in a standby state, since the fixing device 36 is in a keep warm state, the wait time from the standby state to the printable state is diminished. In addition, energy saving effects are also achieved. According to the embodiments disclosed, the heat generating member 361*b* is divided into a plurality of heat generating member groups. However, the heat generating member may also be undivided.

In the present disclosure, the heat storage member 361*e* is provided across the entire longitudinal direction of the bottom surface of the insulator substrate 361*a*. However, the heat generating member may also be divided. In this case, if the heat generating member is disposed to have a positional relationship that corresponds to a gap that is formed between three heat generating member groups or a gap that is formed between each heat generating member groups, since the temperature drop in the gap in the heating member 361 can be relieved, temperature unevenness in the longitudinal direction of the heating member 361 may be less likely to occur.

Additionally, as illustrated in FIG. 4 and as described above with reference to the construction example of the fixing device, the toner is heated and fixed on the paper P that is sandwiched between the belt 363 and the press roller 366 by the heating unit side of the heating member 361 as the heating member is in contact with the inner side of the belt 363 and is further pressed in the direction of the press roller 366 facing the heating unit side of the heating member. At this time, the belt 363 is driven by the belt transport roller 364 connected to the drive motor. However, the belt 363 may be driven from the press roller side to transfer the paper P.

Figure 8:
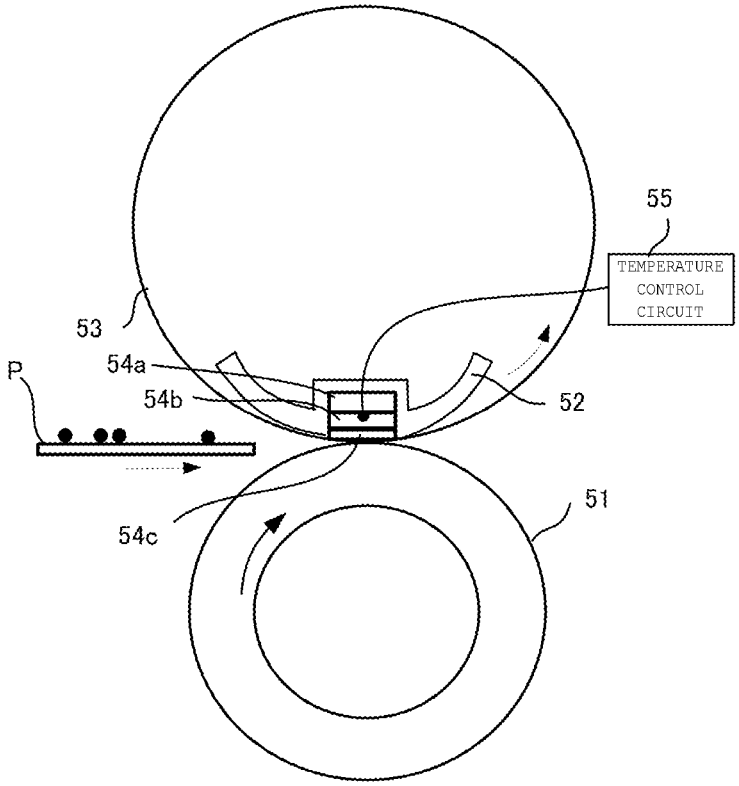
FIG. 8 is a schematic side view of a fixing device, according to another embodiment described herein.

FIG. 8 illustrates an example of a fixing device according to another embodiment. As shown in FIG. 8, the fixing device is driven from the press roller side. A film guide 52 having an arc-shaped cross section and disposed opposite to the press roller 51 is provided, and a fixing film 53 is rotatably attached on the outside thereof. A ceramic heater 54*a*, a plurality of heat generating members 54*b*, and a protective layer 54*c* are provided in the inside of the film guide 52 in a stacked manner. The stacked portion forms a nip portion that is in pressure contact with the press roller via the fixing film. The heat generating members, as described above, are connected in parallel with each other and are connected to a temperature control circuit 55. The temperature control circuit 55 is configured to control the temperature by opening and closing a switching element (not shown).

During operation of the fixing device, the press roller 51, which is operatively connected to the driving motor, is driven and rotated. Furthermore, as the fixing film 53 is in contact with the press roller, the fixing film 53 is also driven and rotated. At this time, the paper P coming between the fixing film 53 and the press roller 51 from the left side, is heated and fixed by the heat generating members 54*b*, and is discharged to the right side.

Thus, the fixing device of the present exemplary embodiment may also have a structure applying a driving force from the press roller side.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and equivalents are intended to cover such forms of modifications as would fall within the scope and spirit of the invention.

What is claimed is:

1. A fixing device, comprising:

a belt;

a substrate having a first side and a second side opposite the first side;

a heat generator on the first side of the substrate and configured to heat the belt to a temperature within a target temperature zone;

a heat storage member on the second side and comprising a latent heat material having a melting point within the target temperature zone; and a press roller configured to form a nip with the belt.

2. The fixing device of claim 1, wherein the press roller comprises an elastic layer formed thereon.

3. The fixing device of claim 1, wherein the belt comprises an elastic layer formed thereon.

4. The fixing device of claim 1, wherein the heat generator contacts an inner surface of the belt.

5. The fixing device of claim 4, wherein the nip is between the heat generator and the press roller.

6. The fixing device of claim 1, wherein the heat generator extends along a longitudinal direction of the substrate.

7. The fixing device of claim 1, wherein the heat storage member is shorter than the substrate in a direction along a longitudinal direction of the substrate.

8. The fixing device of claim 1, further comprising a temperature sensor configured to detect a temperature of the heat storage member.

9. The fixing device of claim 8, wherein the temperature sensor contacts the heat storage member to detect the temperature of the heat storage member.

10. The fixing device of claim 8, wherein the temperature sensor comprises a plurality of temperature detecting elements contacting the heat storage member to detect the temperature of the heat storage member.

11. The fixing device of claim 1, wherein the latent heat material comprises a sugar-based material.

12. The fixing device of claim 1, wherein the latent heat material comprises a xylitol-based material.

13. The fixing device of claim 1, wherein the latent heat material comprises an alcohol-based material.

14. An image forming apparatus, comprising:

an image forming unit configured to form an image on a sheet;

a belt;

a substrate having a first side and a second side opposite the first side;

a heat generator on the first side of the substrate and configured to heat the belt to a temperature within a target temperature zone;

a heat storage member on the second side and comprising a latent heat material having a melting point within the target temperature zone; and a press roller configured to form a nip with the belt to convey the sheet through the nip.

15. The image forming device of claim 14, further comprising a temperature sensor configured to detect a temperature of the heat storage member.

16. The image forming device of claim 15, wherein the temperature sensor contacts the heat storage member to detect the temperature of the heat storage member.

17. The image forming device of claim 16, further comprising:

a controller configured to control a temperature of the heat generating member based on temperatures detected by the temperature sensor.

18. The image forming device of claim 16, wherein the temperature sensor comprises a plurality of temperature detecting elements contacting the heat storage member to detect the temperature of the heat storage member.

19. The image forming device of claim 18, wherein the heat generator comprises a plurality of heat generating elements.

20. The image forming device of claim 19, further comprising:

a controller configured to control, respectively, each of the plurality of heat generating elements based on temperatures detected by the plurality of the temperature detecting elements.

* * * * *